US006462662B1

(12) United States Patent
Rondow et al.

(10) Patent No.: US 6,462,662 B1
(45) Date of Patent: Oct. 8, 2002

(54) METHOD AND APPARATUS FOR REMOTE CUEING IN THE PERFORMING ARTS

(75) Inventors: Christian Rondow, North Vancouver; Emilio Bernabei, Vancouver, both of (CA)

(73) Assignee: Prompt Technologies Inc., Point Venture, TX (US)

( * ) Notice: Subject to any disclaimer, the term of this patent is extended or adjusted under 35 U.S.C. 154(b) by 0 days.

(21) Appl. No.: 09/290,401

(22) Filed: Apr. 13, 1999

Related U.S. Application Data

(60) Provisional application No. 60/081,526, filed on Apr. 13, 1998.

(51) Int. Cl.[7] ..... G08B 1/00; G08B 5/22; G08B 5/00; G08C 19/00

(52) U.S. Cl. ..... 340/573.1; 340/309.4; 340/309.15; 340/825.69; 340/7.61; 340/332

(58) Field of Search ..... 340/7.58, 7.61, 340/7.6, 7.63, 309.3–309.6, 309.15, 573.1, 573.3, 7.1, 7.47, 7.3, 7.31, 825.69, 825.72, 851.6; 341/176

(56) References Cited

U.S. PATENT DOCUMENTS 4,408,187 A 10/1983 Rollins ..... 340/332
5,085,609 A * 2/1992 Haberle ..... 446/83
5,510,800 A 4/1996 McEwan ..... 340/387
5,661,490 A 8/1997 McEwan ..... 342/287
5,815,077 A * 9/1998 Christiansen ..... 340/573.3

FOREIGN PATENT DOCUMENTS

CA 2200670 9/1998
CA 2239846 12/1998

* cited by examiner

*Primary Examiner*—Brian Zimmerman
*Assistant Examiner*—Mai Nguyen
(74) *Attorney, Agent, or Firm*—Clark Wilson

(57) ABSTRACT

A wireless remote cueing apparatus controlled by an electronic triggering apparatus used to cue performers in a theater, film production stage, exterior set or other performing arts environment. The cueing device is a small disc which contains electronic components able to receive coded RF transmissions and convert specific signals into physical vibration patterns or visual indicators such as a flashing LED. The triggering apparatus is an electronic component able to transmit coded RF signals to many different remote cueing devices. The triggering device has a button associated with each remote cueing mechanism; when the button is pressed, the associated remote cueing device responds by vibrating or flashing a LED. Many triggering apparatus can be interfaced to a central computer running a computer program which facilitates more complex cueing arrangements.

10 Claims, 15 Drawing Sheets

METHOD AND APPARATUS FOR REMOTE CUEING IN THE PERFORMING ARTS

This application claims benefit of provisional application Ser. No. 60/081/526 filed Apr. 13, 1998.

BACKGROUND OF THE INVENTION

1. Field of the Invention

This invention relates to a wireless remote cueing system used in the performing arts or public performance events.

2. Discussion of the Related Art

Simple cueing systems have always been used in the performing arts. There is an inherent need to alert actors, musicians, news anchors, dancers and various other public performers and also associated background workers, to the fact that they must initiate action. For the purposes of this invention, all such individuals who are to be cued to perform, will be termed "performers" and all those individuals who are to cue the performers are termed "directors" or assistant directors (ADs) or background worker performers, as the case may be. Even those not knowledgeable in directing performances understand the age-old director's shout of "Action!". That oral command is indeed one common form of cueing system but it is not the most efficient method.

The oral cueing of performers created a myriad of problems during the production of filmed entertainment including, but not limited to (1) unwanted voices on film audio tracks requiring expensive post-production editing; (2) missed cues due to performers not hearing the oral cues causing expensive and, in the case of live broadcasts, embarrassing re-takes; (3) difficulty in cueing multiple groups of performers multiple times without human error in timing between cues and; (4) inability to cue performers who are too far to hear oral commands or who are enclosed in areas where audible cues are impossible to hear.

Visual cueing systems can be as simple as the raising of one's hand or the turning on and off of a small flashlight. They can also be automated such as the one described in U.S. Pat. No. 4,408,187 which discloses multiple adjacent visual indicators near the camera used to cue performers—most likely used to cue newscasters during live broadcasts. The disadvantage with these systems is that a direct line-of-sight is required and the invention does not lend itself to complete stealthy cueing, as cameras may inadvertently film the flashing lights.

During the production of films where multiple groups of performers, stunt persons, and extras are cued at various times during a shot, the director uses a network of ADs with walkie-talkies to orally cue ADs. The AD then orally indicates to performers to initiate a task or, when absolute silent cueing is required, touches the performer lightly or waves a hand. This archaic human cueing systems is used commonly today because of its simplicity, flexibility and stealthy cueing aspect. But it has disadvantages, including: (1) it is prone to human error in timing and coordination of multiple performers, thus causing missed cues and re-takes; (2) it requires many ADs thus increasing the fixed production expenses tremendously; (3) it introduces audible walkie-talkie noise throughout the set, ruining audio tracks and causing confusion and; (4) it is impossible to exactly reproduce a set of sequential cues without introducing variations from human error.

One objective of this invention is to solve the old problem of cueing in the performing arts industry by building a method and apparatus that meets the following requirements: (1) the invention must be portable, as directors are always on the move; (2) the invention must provide silent cueing, as audible cues ruin the finished product and increase cost of post-production; (3) the invention must have a cue controller for the director and a cueing device for the performer; (4) the cueing device must be wireless, so performers may move freely; and (5) the cueing device must be small enough to be concealed on the performer's person. No method to-date meets these basic requirements.

According to the invention, the cueing device is small enough to be concealed in a pocket or other area near or on the person of a performer. A portable radio frequency (RF) transmission device, the cue controller, activates the small wireless cueing device which alerts the performer through vibration against the body or a visual cueing signal. Cueing controller can activate a single cue device or a plurality of cue devices simultaneously if required. This invention is usefully employed in the field of theater, film production, concerts, political rallies and other similar performing arts or public performance events, where the need for precise and silent cueing is essential to success.

SUMMARY OF THE INVENTION

The invention is characterized by a cue controller having a unique identification code imbedded in its integrated circuitry (IC). Cueing controller is used by the director or AD to manage a plurality of cue devices, each cue device also having a unique identification code imbedded in the IC as well as the identification code of the cue controller. Multiple cue controllers located in close proximity of one another can manage different sets of cue devices by transmitting the cue controller's unique key with the target cue's unique key. This creates a unique key pair which uniquely identifies a single cue device.

The cue device's exterior casing can be modified depending on the performer's preference, while the internal IC components remain static. This allows the cue circuitry to be covered, for example, in skin-tone colored rubber material and worn against the skin or enclosed in a hard plastic casing and put inside a coat or pant pocket. What remains constant is the cueing device's ability to pick up coded RF transmissions from various cue controllers, identify whether the message is intended for it, and vibrate or light up accordingly. Optionally, the cue can cause a visual indicator to illuminate if so requested in the coded RF transmission.

The cueing controller is a special purpose computer device which provides a complete management interface to the director. Primary functions provided by the cue controller are the configuring of performer names, the matching of performer names to cue identifiers, the provision of a plurality of buttons used for signalling a particular cue device, the provision of a button for the purpose of recording cueing sequences, the provision of a button for playing back cue sequences and the provision of persistent computer memory for storing sets of cueing sequences.

For very large performances where there may be hundreds of cued individuals, the master cue controller is used. The master cue controller is a computer program and computer hardware peripheral able to transmit coded RF messages which, when used together, can coordinate the signalling of many cue devices thus serving as a proxy for all cue controllers. The RF transmission device accepts commands through a computer serial port interface and has been pre-coded with the identification codes of the cue controllers for which it is serving as proxy.

BRIEF DESCRIPTION OF THE DRAWINGS

The features and advantages of the present invention will become more clearly appreciated from the following description taken in conjunction with the accompanying drawings in which.

DETAILED DESCRIPTION OF THE PREFERRED EMBODIMENTS

Figure 1:
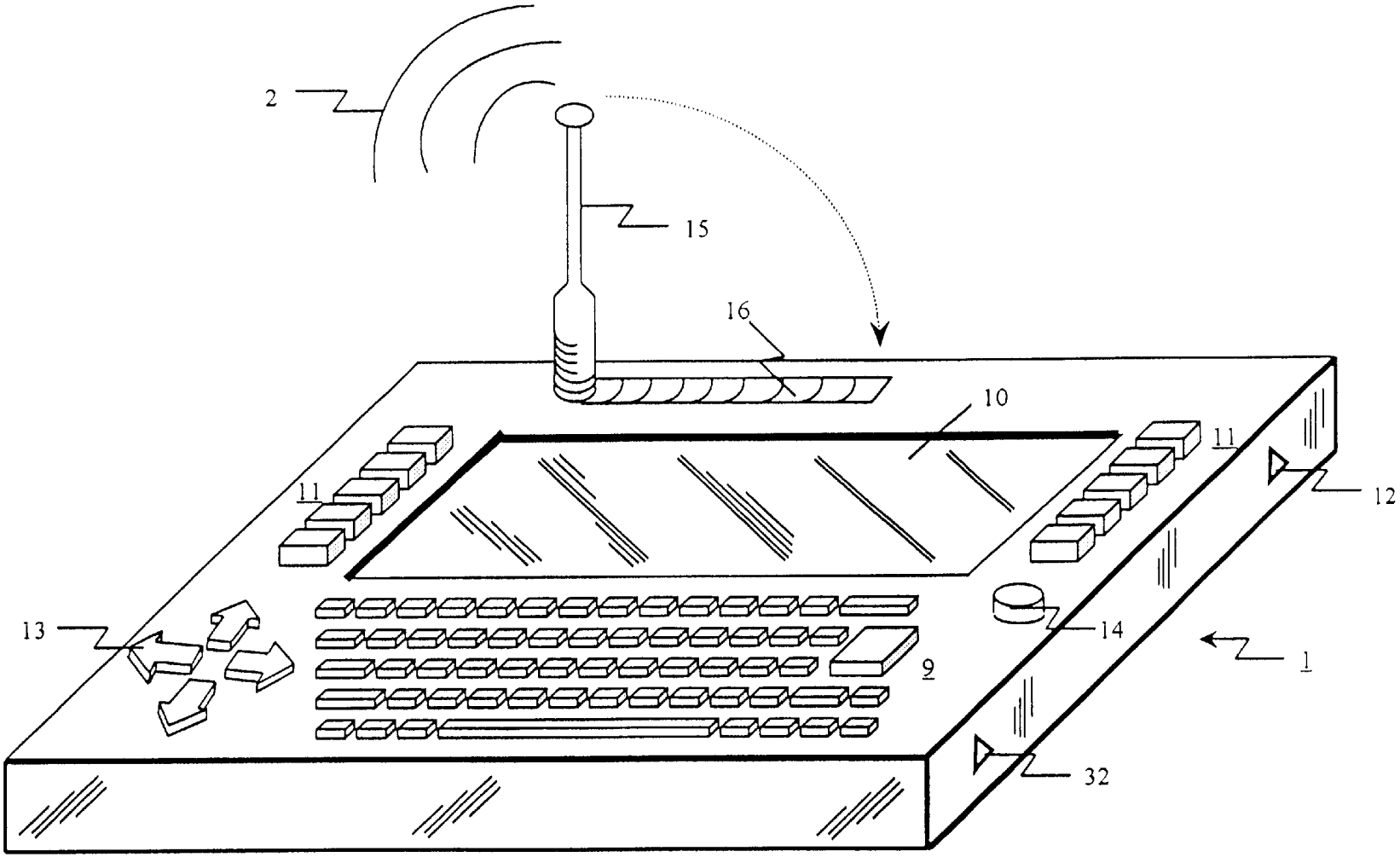
FIG. 1 is a perspective view of the preferred embodiment of the cue controller.

Cue controller 1 is a microcomputer device that is equipped with an RF transceiver and associated circuitry to broadcast RF signals 2 specially coded for specified cueing devices 3. Cueing device 3 is a microcomputer device carried by the performer which receives coded RF transmissions 2 from cue controller 1 intended for it, and instigates a tactile or visible cue 4 in response.

Figure 8:
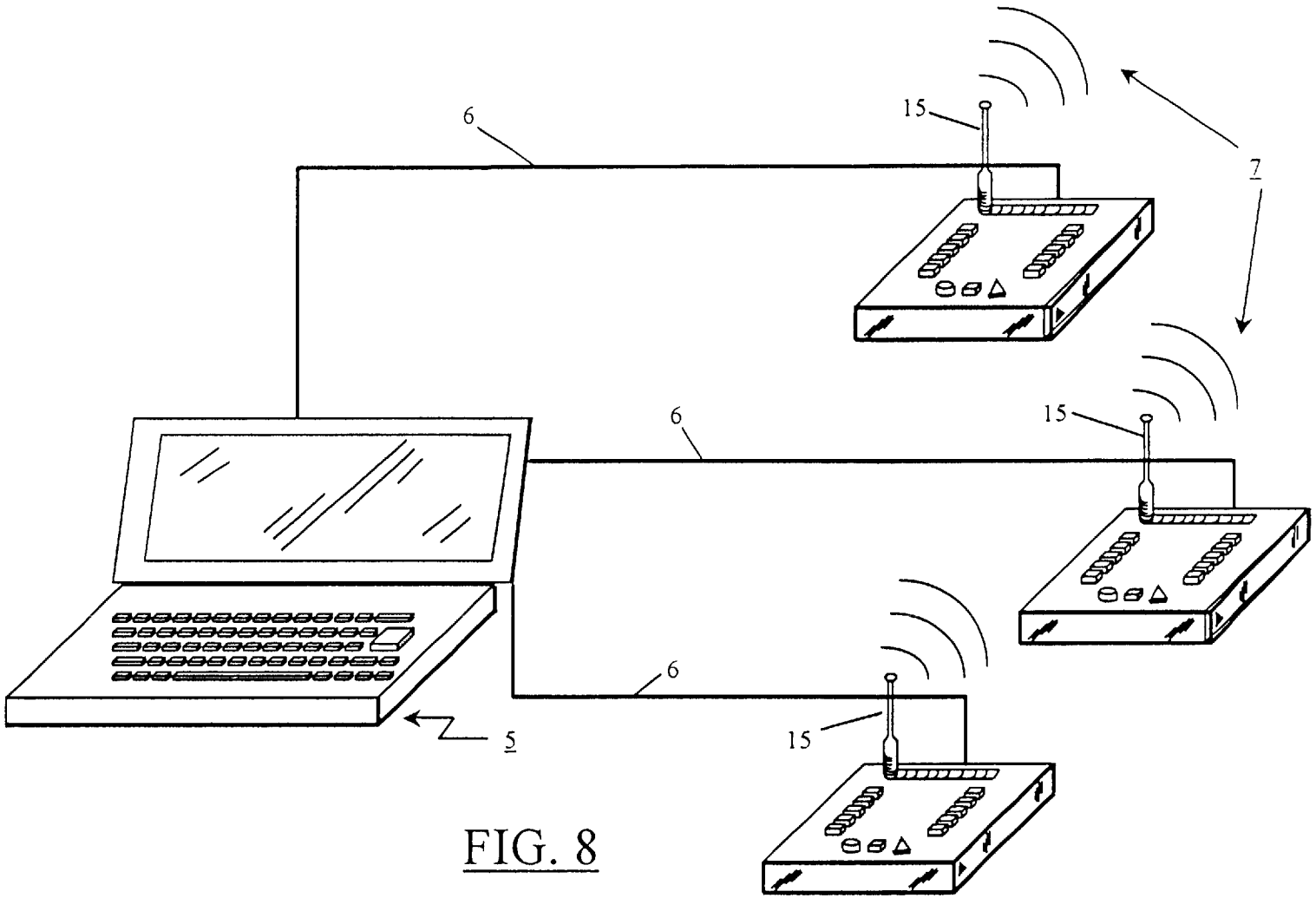
FIG. 8 is a perspective view of one embodiment of the master cue controller with several cue controllers.

As shown in FIG. 8, master cue controller 5 is a computer in electronic communication with a plurality of cue controllers 1 using wire 6 or wireless methods (e.g. RF interface). Master cue controller 5 runs a software program which can trigger individual cue controllers 1 to transmit coded RF messages 7 to various cueing devices 3. Cueing devices 3 receive and interpret coded RF transmissions 2 from cue controllers 1, unaware of the method used to trigger the RF transmission.

Figure 2:
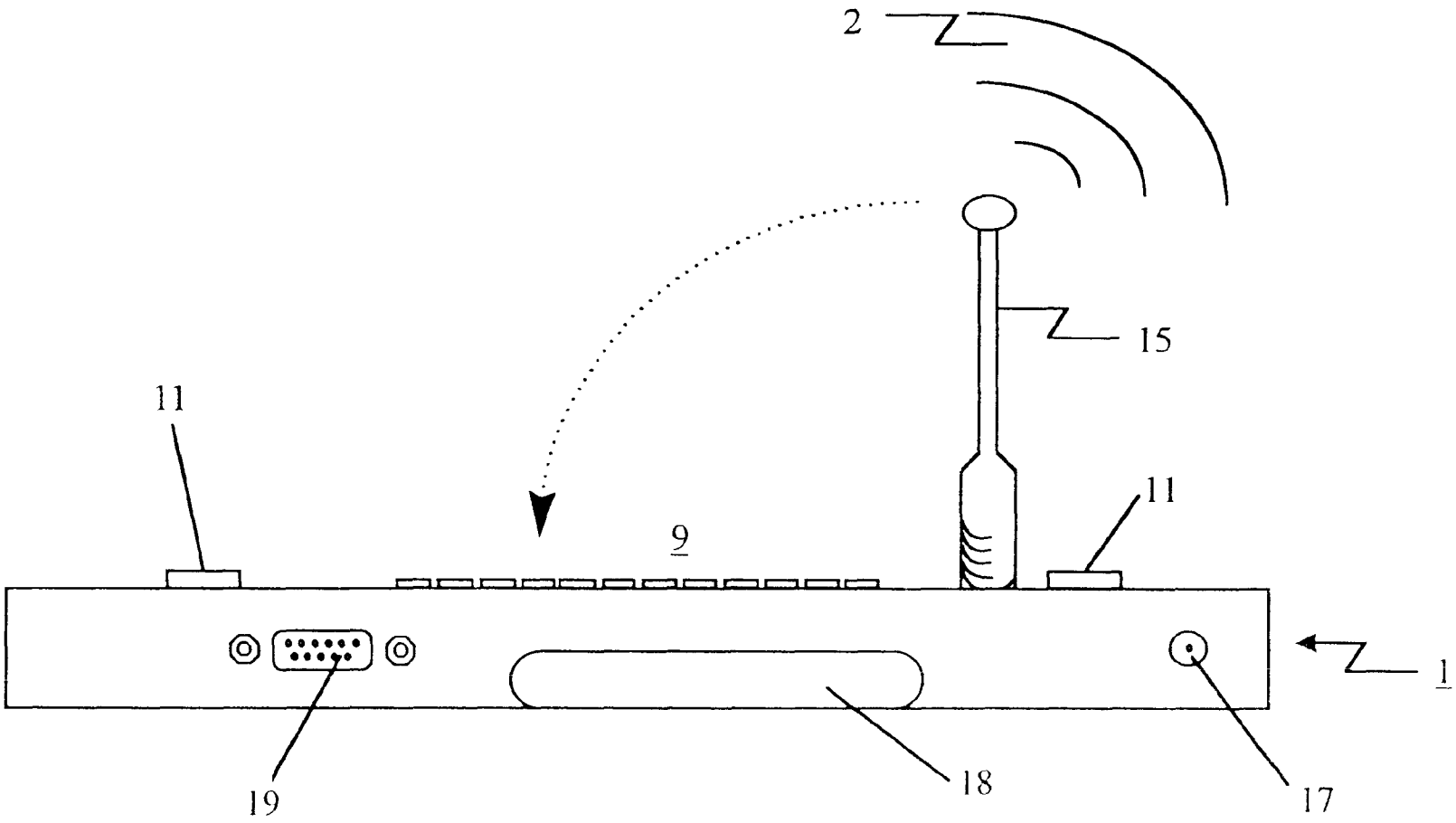
FIG. 2 is a rear view of the cue controller of FIG. 1.
Figure 3:
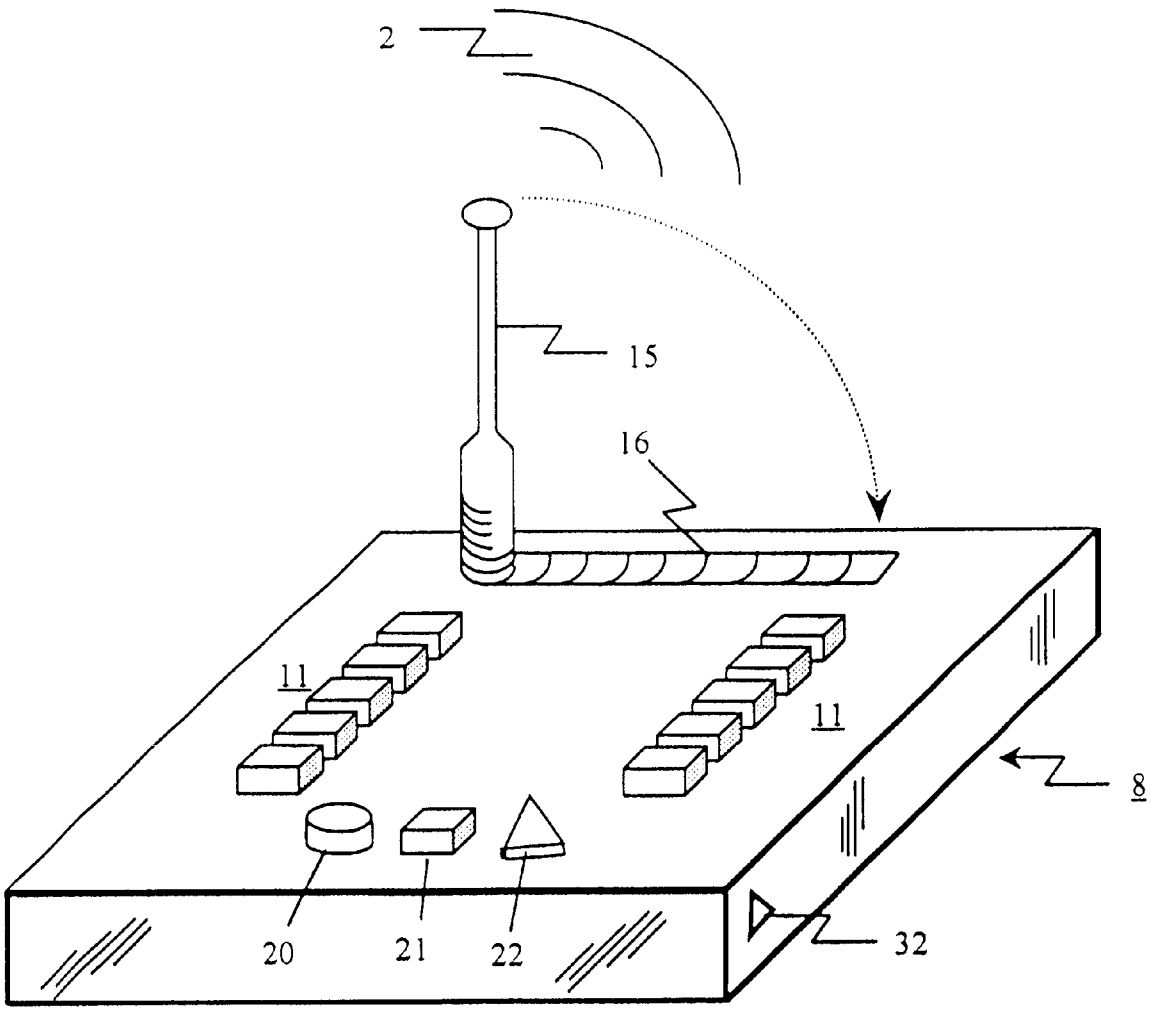
FIG. 3 is a perspective view of another embodiment of the cue controller.
Figure 4:
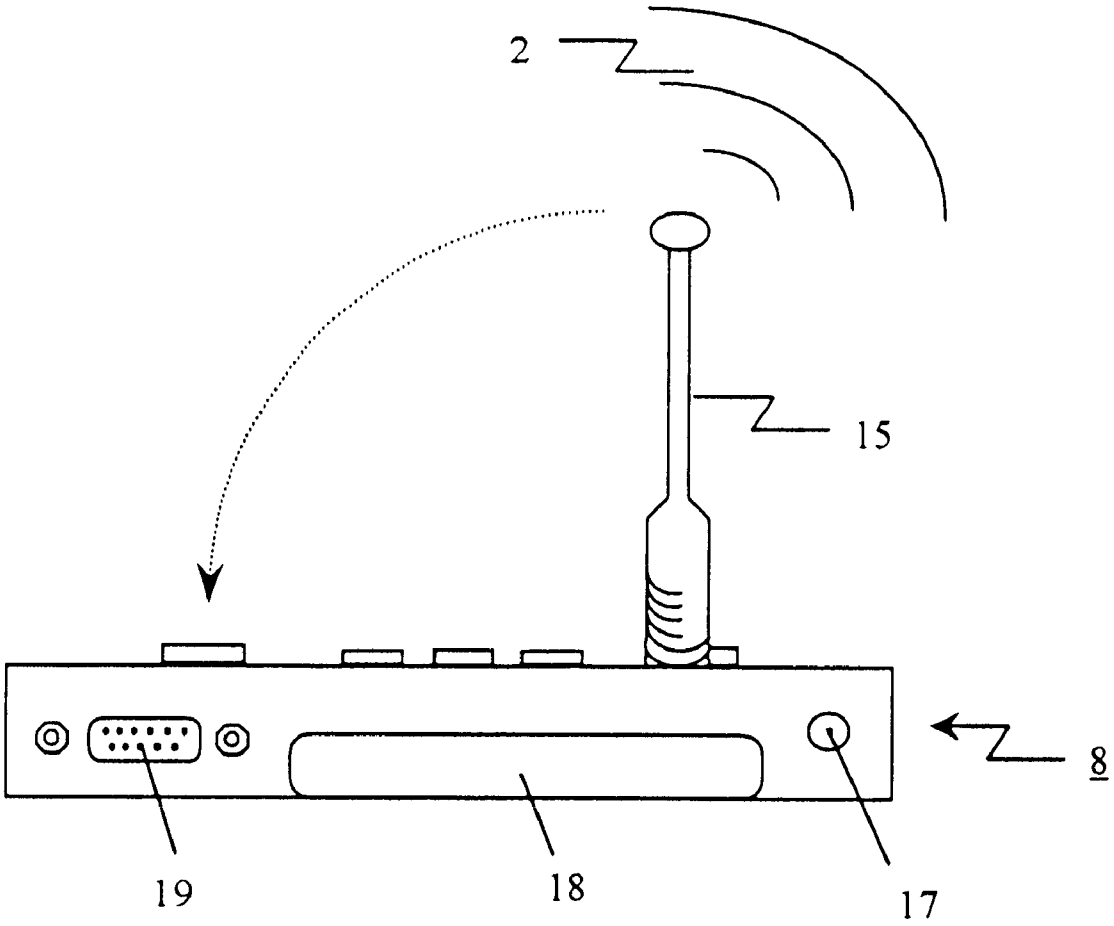
FIG. 4 is a rear view of the cue controller of FIG. 3.
Figure 5:
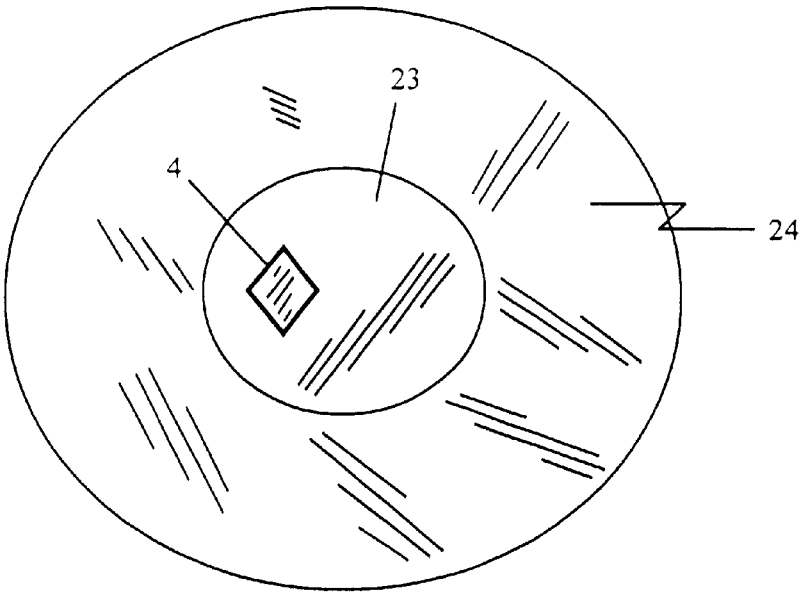
FIG. 5 is a plan view of the cueing device.
Figure 6:
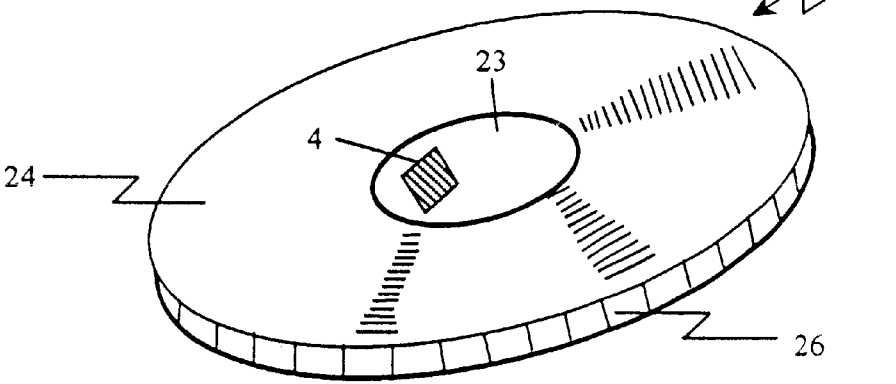
FIG. 6 is a perspective view of the cueing device of FIG. 5.
Figure 7:
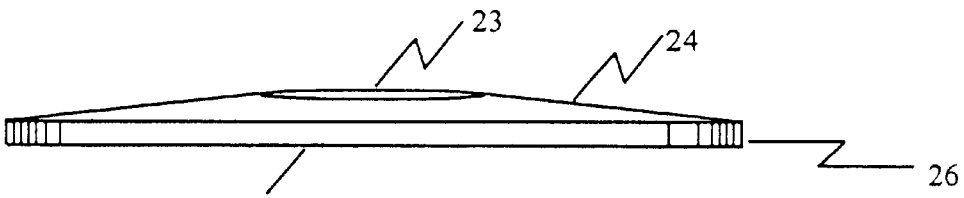
FIG. 7 is a side view of the cueing device of FIG. 5.

FIG. 1 and FIG. 2 show the preferred embodiment of the cue controller 1. FIG. 3 and FIG. 4 show a second, simpler embodiment being cue controller 8. FIGS. 5–7 show the preferred embodiment of the cueing device 3. FIG. 8 shows the preferred configuration of the master cue controller 5.

In FIG. 1, cue controller 1 includes an alphanumeric keypad 9 used to enter performer's names, cue sequence names and other descriptive text. All information entered into cue controller 1 is saved to memory. Flat-panel display 10 is provided for displaying the aforementioned names beside each cueing button 11, which are disposed five on each side of flat-panel display 10. Flat-panel display 10 can be illuminated using the back-light button 12 when cue controller 1 is used in dark areas. Arrow keys 13 are included on the keypad to allow the director to. scroll upwards and downwards through the list of performers and named cue sequences, thus effectively expanding the number of separate cueing devices 3 which can be triggered.

Cue sequences can be recorded, stored and replayed using record button 14 on the keypad area of cue controller 1. To assign a cue sequence to a particular cueing button 11, the record button 14 and then one of ten cueing buttons 11 are pressed—the cue recording sequence then begins immediately. Every cueing button 11 pressed thereafter is recorded in sequence in memory, as well as the exact number of seconds between each successive cueing button 11 pressed. The cue sequence ends when record button 14 is again pressed and the cue sequence is named using the alphanumeric keypad 9. Replay of the cueing sequence thus recorded and stored, is initiated by the pressing of the associated cueing button 11.

Cue controller 1 has a RF antenna 15 which folds into a complementary recess 16 on the top face thereof for efficient and safe storage of cue controller 1 (i.e. without damaging antenna 15). Optionally, cue controller 1 may have an UHF receiver (shown in FIG. 17) for receiving signals from a video camera.

Shown in FIG. 2, the rear of cue controller 1 has a DC power adapter socket 17 and a battery bay 18 used as an alternative to the DC power adapter source 17. The type of battery to power cue controller 1 could be a nickel-cadmium variant or some other fuel cell. Cueing controller 1 is powered on using the on/off switch 32.

Also in FIG. 2, cue controller 1 has an external computer interface 19 at the rear of the unit such as RS-232 or RS-449 data connection. This allows external microcomputers to digitally actuate cue triggers by sending coded messages to cue controller 1 through interface 19. External computer interface 19 may also be used to download cue sequences previously recorded by cue controller 1.

Radio frequency transmission is accomplished in the following fashion: after the director presses a cueing button 11 or the cue trigger is effected by the execution of a preprogrammed cue sequence (see below??), the microcomputer code determines which performer name was associated with that trigger. The performer name was previously entered and associated with a cueing device 3's unique identifier, so the microcomputer now. knows which cueing device 3 to signal. Cueing controller's 1 own unique identifier is appended to the cue unique identifier and the resulting digital message is modulated over an RF signal 2 and broadcast via antenna 15.

FIG. 3 shows a simpler variation of the FIG. 1 embodiment of cue controller 1. Cue controller 8 does not have a flat-panel display 10 device or a keypad 9 for alphanumeric entry. Instead, there are three buttons near the bottom of cue controller 8 which resemble a circular shape 20, a square shape 21 and an arrowhead shape 22. To begin recording a cue sequence associated with a particular cueing button 11, the director presses the circular button 20 and then the desired cueing button 11. Thereafter, any cueing button 11 pressed becomes part of the cue sequence. To stop recording, the director presses the square button 21. To play a particular cue sequence back, the director presses the arrowhead button 22 and then the desired cueing button 11.

In FIG. 4, a rear view of cue controller 8 embodiment is shown. External computer interface 19, battery bay 18, and DC power connector 17 are used in a fashion similar to cue controller 1 as shown in FIG. 2.

Cueing device 3 should be profiled to "read as a wallet", which means that to the audience or the camera, the presence of cueing device 3 on the person of the performer should not be any more apparent than a wallet. For many applications, cueing device 3 is advantageously formed in the shape of a small hockey puck with height of about 0.6 inches (or 1.5 cm), and an outer diameter of about 3.25 inches (or 8 cm). The resin for potting cueing device 3 may be epoxy encapsulate so that the result is waterproof and rugged.

Figure 16:
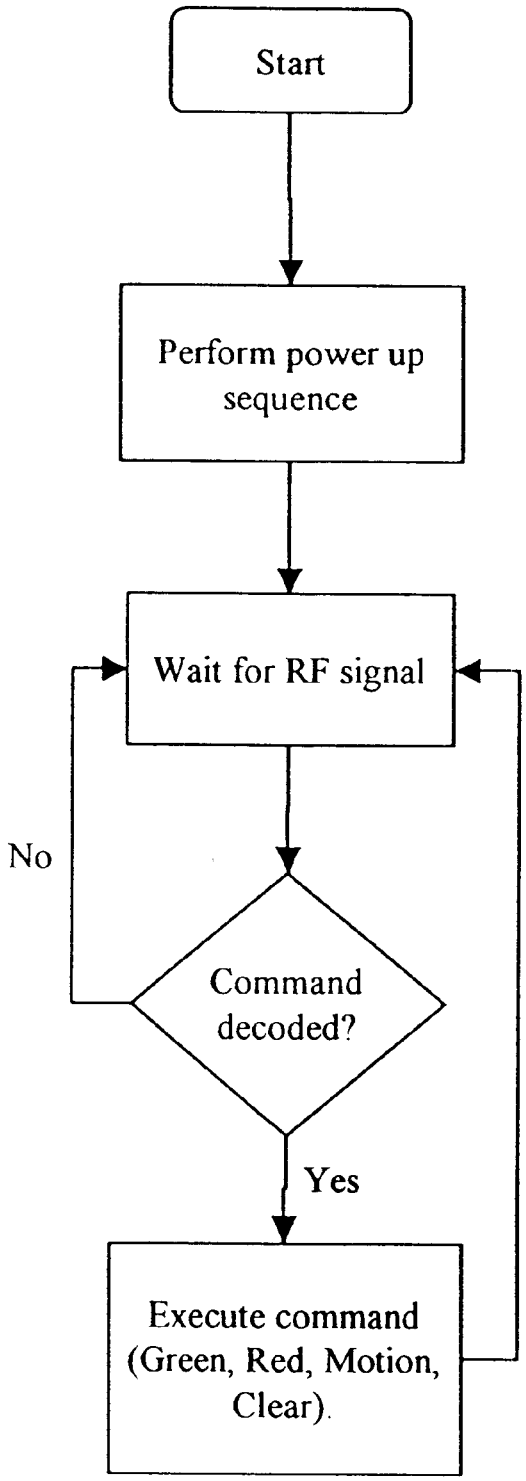
FIG. 16 is a flowchart for processes of the cueing device.

Cueing device 3 houses a RF transceiver, rechargeable batteries, a vibrator (perhaps a motor) and indicators symbolically designated 4 and associated electronic circuitry, all being conventional and not shown for simplicity; all to perform the steps of FIG. 16 Also, cueing device 3 has a conventional socket port (not shown) for accepting a complementary jack (not shown). The jack can be used to permit connection with a recharger for recharging the batteries of cueing device 3. As well, the socket is mechanically and electrically configured to normally enable the batteries to power the circuitry of cueing device 3 but to disable the batteries when the jack is inserted (so that when the jack is not connected to a recharger, the insertion of the jack shuts off, and the removal of the jack turns on, cueing device 3). Cueing device 3 can also transmit RF signals (for an application explained below as EXAMPLE C).

In FIGS. 5–7, different views of the preferred embodiment of a cueing device 3 are shown. FIG. 5 shows a top plan view of the circular cueing device 3. Of particular interest is indicator 4 used as a visual cue during scenes where silent cueing is required—it may be one LED or several (perhaps coloured differently) to indicate different messages (stop or go, for example). Top 23 of cueing device 3 is flat and is in spaced parallel relationship to bottom surface 25, while the sides 24 are bevelled downwardly from top 23 to meet side walls 26.

FIG. 6 and FIG. 7 show that cueing device 3 has a flat bottom 25, unlike the sloping nature of the top area 24, to allow cueing device to be placed directly against the performer's body (e.g. in a shirt pocket) with minimum bulge. Cueing device 3 has circumferential side walls 26 extending vertically from bottom 25. Circling the interior of cueing device 3, along the side walls 26, is an antenna for RF transceiving capability.

Cueing device 3 can also transmit RF signals to be received by another device (like a camera) so that when cueing device 3 is carried by a moving performer, that other device may be able to determine automatically, useful information based on the (moving) location of cueing device 3. For example, some scenes require the camera to follow closely the performer as he moves around. This camera is typically of the SteadiCam®-type of camera and requires two persons to follow the performer—one to carry the camera and one to keep the camera in focus on the performer while both performer and camera are in motion. With the present invention and conventional adaptation of the camera, there is no need for the second person. The performer-carried cueing device 3 transmits RF signals which can be used to determine automatically the separation between the moving performer and the moving camera, by using conventional distance-measuring and position-sensing technologies (e.g. based on measuring the direct time-of-flight of a transmitted RF signal) adapted for the camera. This separation information is then used by the servomechanisms in the camera to keep the camera in focus on the performer.

In FIG. 8, master cue computer 5 has programming for control a plurality of cue controllers 1 or simpler cue controllers 8. Each cue controller 1 or 8 has an external interface cable 6 attached between its rear interface port 19 and master cue microcomputer 5 (although wireless interaction is also possible). The director uses master cue controller 5 to configure performers and their respective cueing devices 3, to match performer names to cue device identifiers and cue controller identifiers, to trigger cue signals 7 on key-press or computer mouse click, to save cue sequences to a persistent storage area such as a database on diskette or hard drive, and to play back cue sequences on command.

Figure 14:
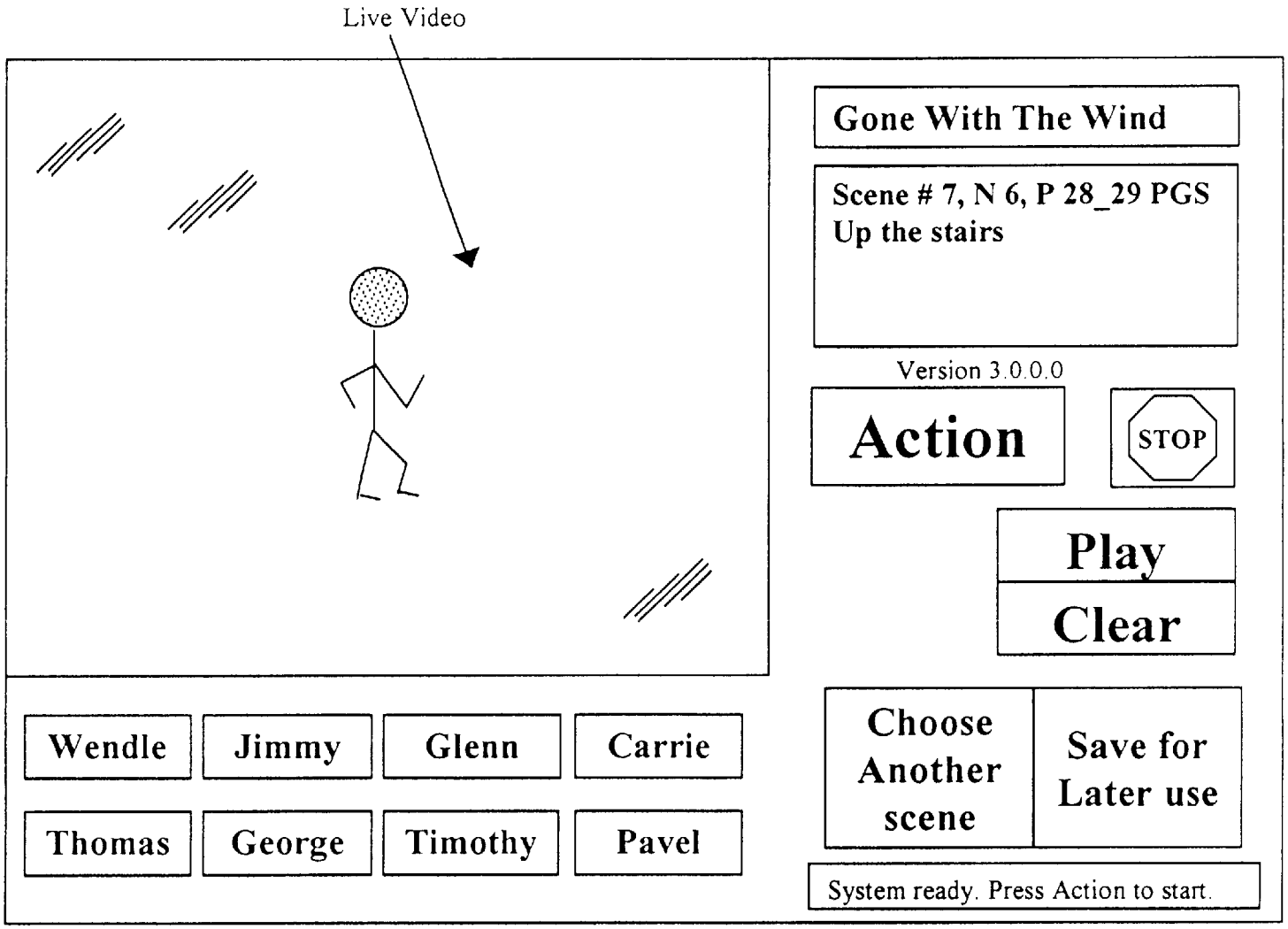
FIG. 14 is a screen shot of the Main Cueing screen.
Figure 15:
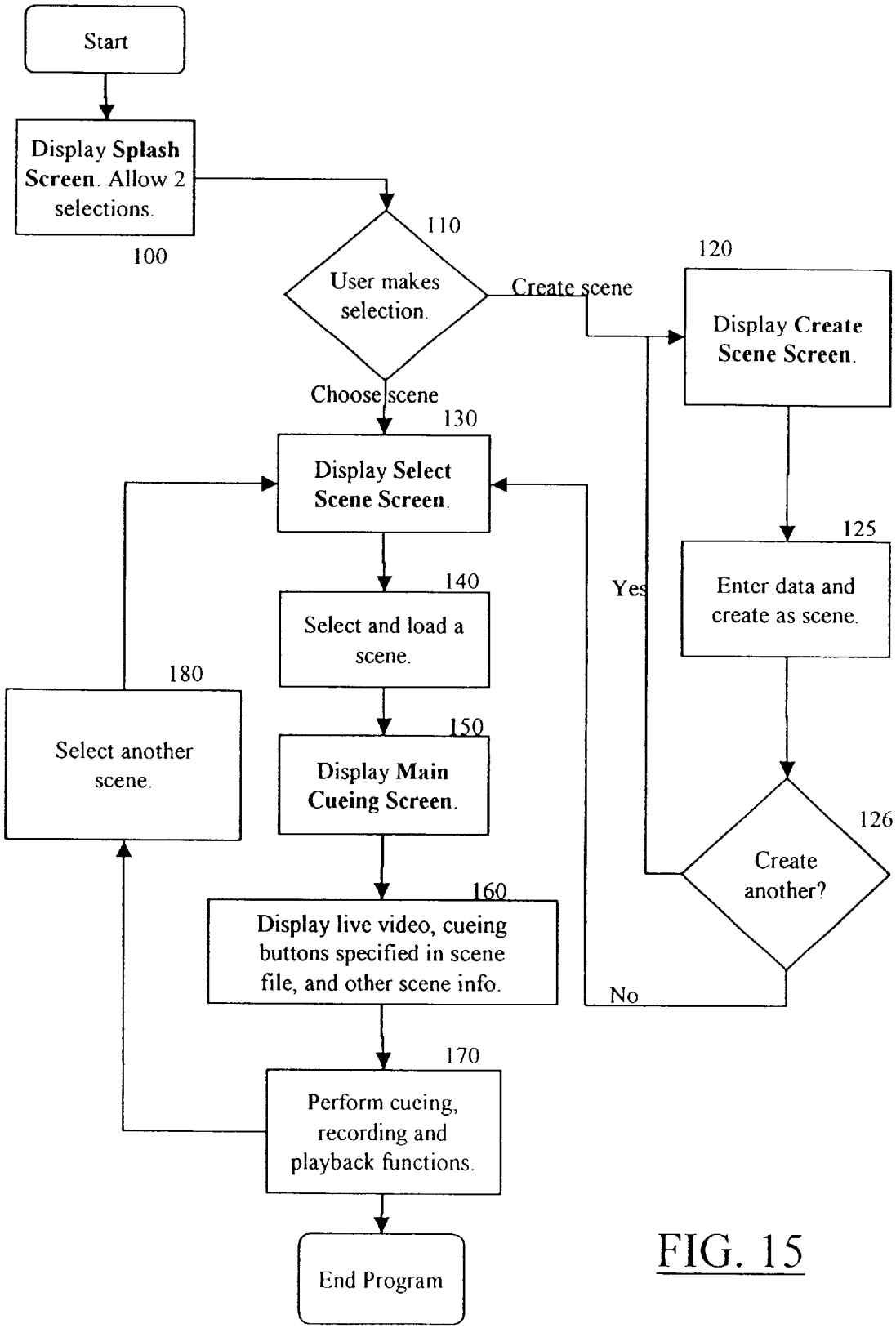
FIG. 15 is a flowchart for processes of the cue controller.

A typical filming application following a printed script is explained using the present invention following a printed scripted with reference to FIG. 15 (being a flow chart of steps taken by the director with cue controller 1) and FIGS. 10–14 (being screen shots presented to the director by cue controller 1)

The software in cue controller 1 provides a graphical user interface employing conventional touch screen technology.

Typically, the program presents the director or AD an initial choice (step 100 and FIG. 10) whether to create a scene or select a scene previously created. If the director chooses to select a scene, a Select Scene screen is presented by cue controller 1 (steps 110 and 130). If the director chooses to create scene, a Create Scene screen is presented (steps 110 and 120).

Figure 11:
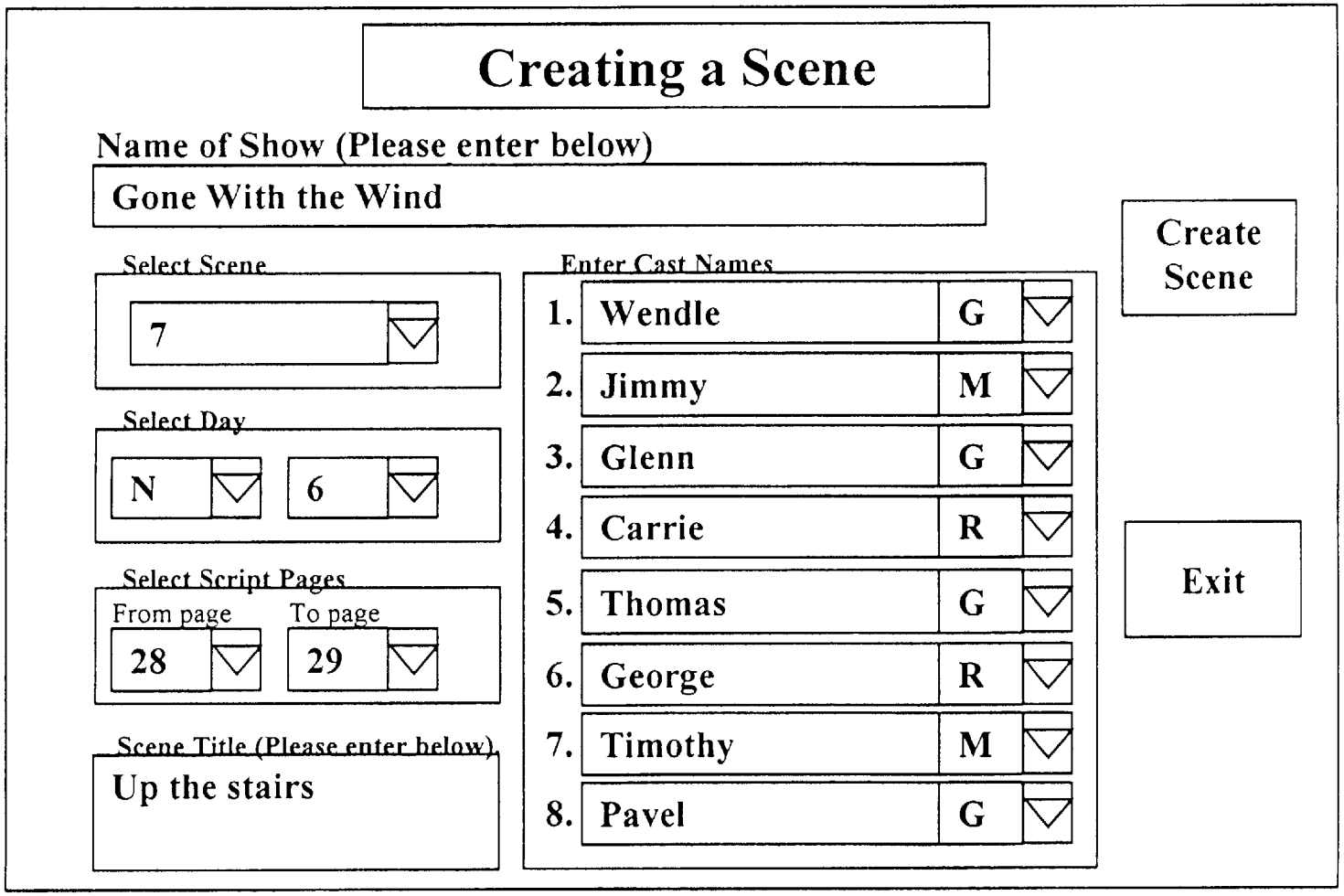
FIG. 11 is a screen shot of the Create Scene screen.
Figure 12:
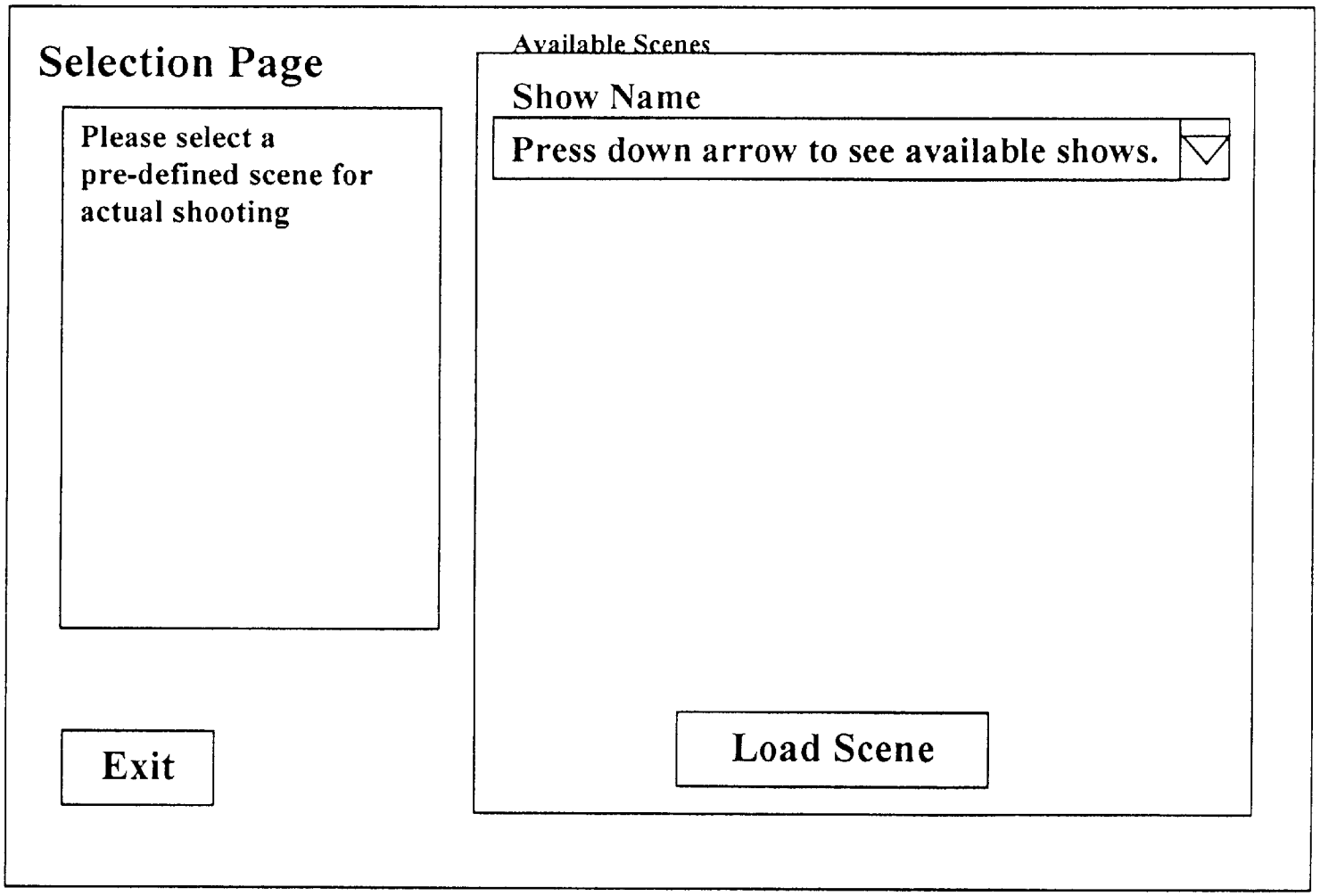
FIG. 12 is a screen shot of the Select Scene screen.
Figure 13:
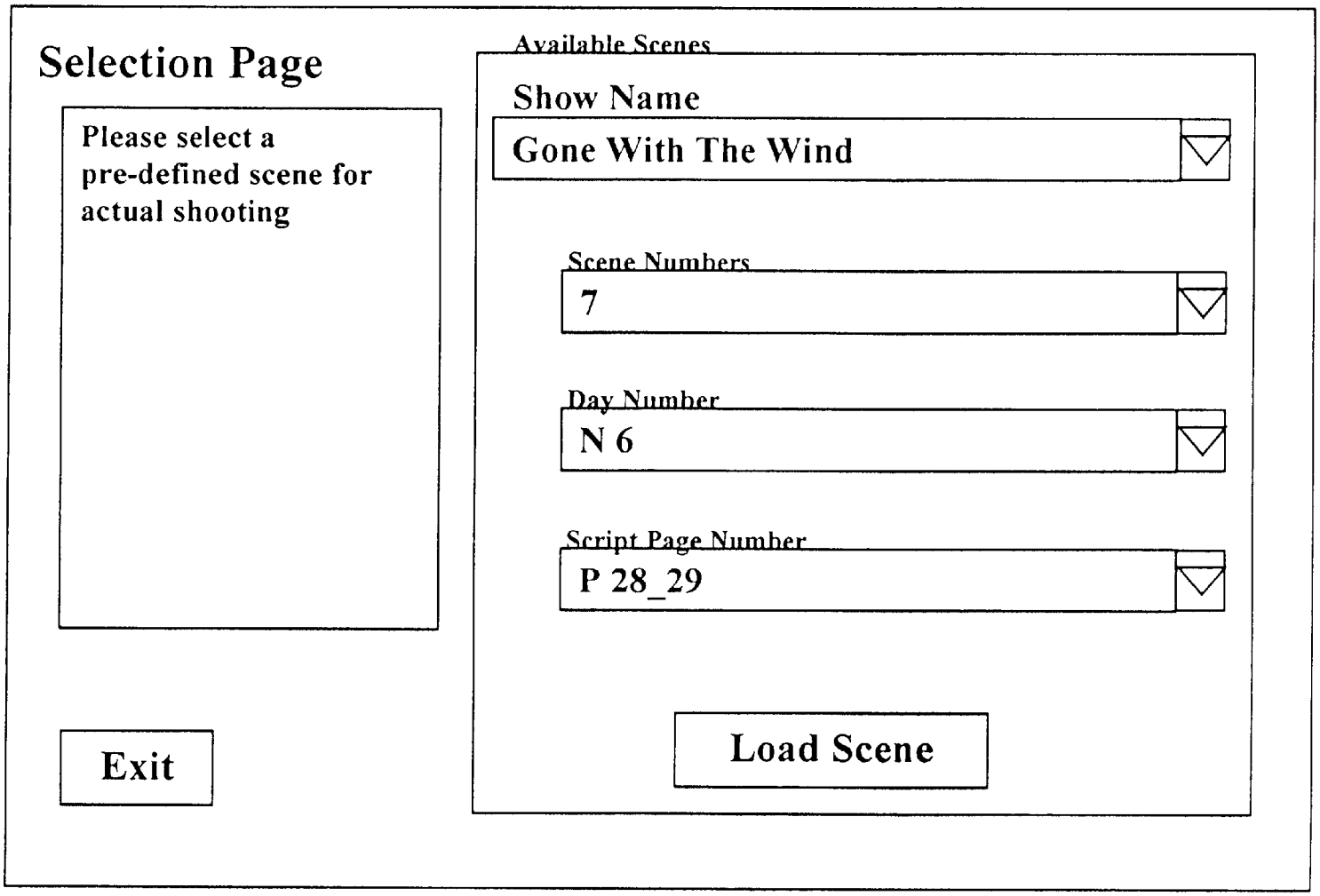
FIG. 13 is a screen shot of the Select Scene screen.

The choice of creating a scene is described first. The director breaks down the printed script into scenes for shooting and inputs relevant data as follows. As seen in FIG. 11 he inputs into cue controller 1 memory for each desired scene, the name of the show (e.g. "Gone with the Wind") and other conventional parameters (such as title of the scene, the script pages, scene number, Day/Night and the number thereof according to the script). As well, he inputs the performers by name (or function, e.g. key grip) and the cues they are to receive. As examples of cues, G could mean that the green LED on cueing device 3 is activated to cue the performer to start an activity according to the script. Similarly, R could mean that the red LED on cueing device 3 is activated to cue the performer to stop an activity according to the script; and M could activate the tactile indicator on cueing device 3, such as motion or vibration, to cue the performer for another action in the script. There may be combinations of the preceding or variations (number of LEDs, their color, length of LED activation or vibration) and the like, each for predefined action.

Scenes for shows are created as described above (steps 125 and 126) and when completed, the director is presented with the select Scene screen (step 130 and FIG. 12,) to select the show to be loaded. Upon choosing, for example, the show "Gone with the wind", and by use of pull-down menus or other conventional user interface mechanisms, the entirety of previously created scenes is presented for selection and loading (step FIG. 13 and step 140).

Once the scene loaded, the Main Cueing Screen is presented (step 150 and FIG. 14) and is informed (step 160) possibly (I) with live video is provided by conventional UHF or similar technology, from a camera or cameras directed to the physical area(s) of the set to be filmed or of interest otherwise to the director, and at least (II) with relevant scene information (as created according to FIG. 11 and associated explanation above). Cueing buttons 11 are provided on the touch screen for cueing the various performers, and their names appear as inputted into the loaded scene selected. In contrast to the physical cueing buttons 11 with software-driven names on display 10 of the embodiment of FIGS. 1–4, and to show another conventional implementation choice, the eight cueing buttons 11 in the screen shots of FIG. 14 are completely software-driven on the display. More generally, keyboard 9, record button 14 and other physical buttons in the embodiment of FIGS. 1–4, can be completely conventionally replaced with software-driven touch screen technology.

If the loaded scene is fresh from being inputted with the parameters from the Create Scene screen and has no queing sequence to run, then that sequence is created as follows. The director presses the "Action" button on the Main Cueing Screen (roughly equivalent to the pressing of record button 14 explained in conjunction with FIGS. 1–4). Then the performance of the scene begins with the performers being cued for their respective performances by the director pressing the appropriate cueing buttons 11 at the appropriate times according to the script to activate the respective cueing devices 3 with visual or tactile indications. The sequence of steps 130 to 170 is repeated as desired (step 180 and pressing "Choose another scene" button on the Main Cueing screen). If a particular performance sequence with triggered cues is considered by the director to be worth saving, he presses "Save for later use" button on the Main Cueing screen, in which case the scene is now stored with the exact timed sequence of the cues.

Upon selection and loading of that scene later (e.g. for a retake) with the Select Scene screen, the director merely presses the "Play" button on the Main Cueing Screen. The exact timed cueing sequence is played automatically. In other words, the performers are cued automatically by cue controller 1; and the director is not required to time and press himself the sequence of cueing buttons 11 but may regain control of the playback sequence at anytime if he desires by pressing the STOP button.

Next are examples showing some uses of this invention's cueing system.

EXAMPLE A

Cueing Two Performers to Framed Area

Figure 9:
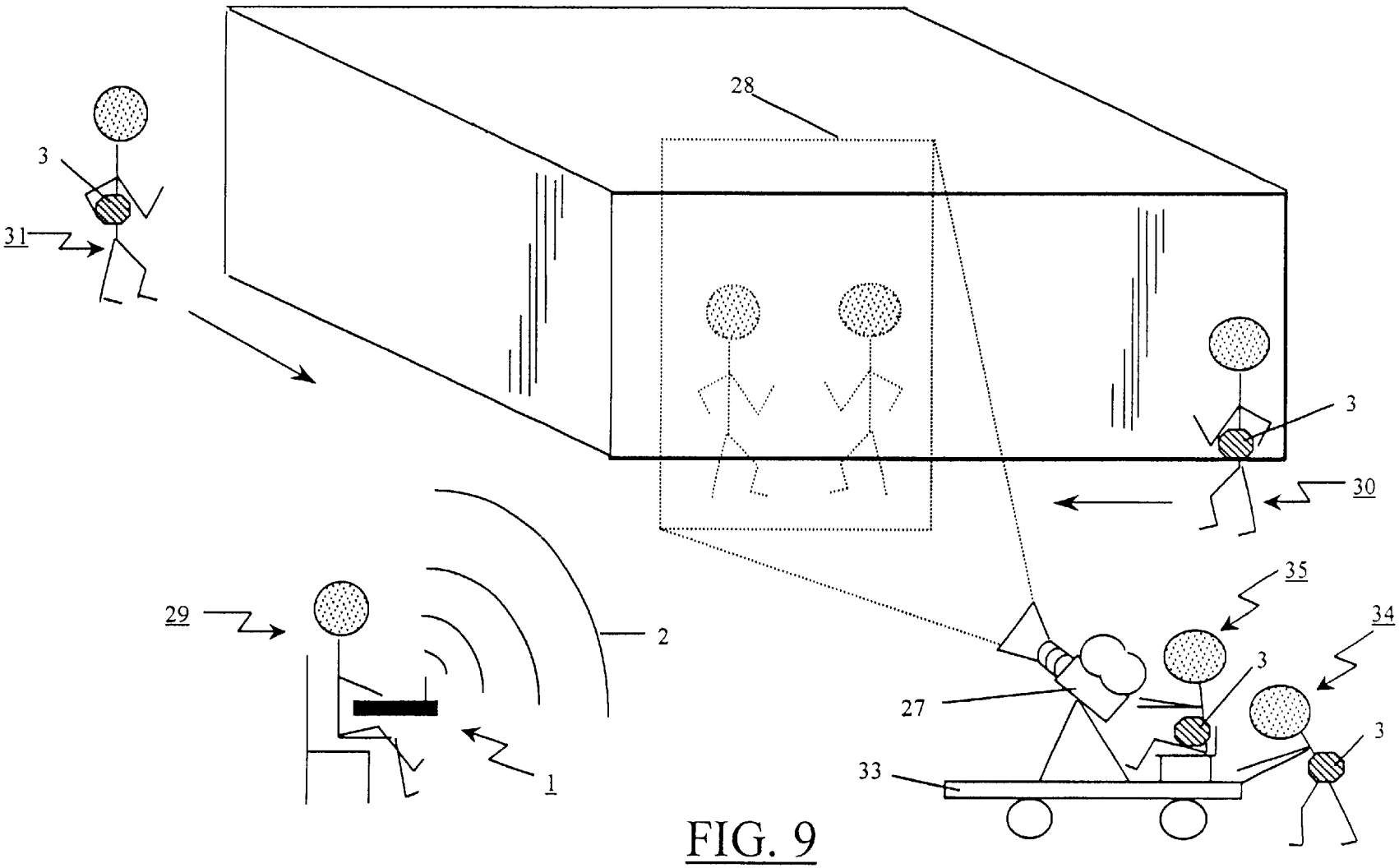
FIG. 9 is a perspective view of the invention in use on a motion picture production set.
Figure 10:
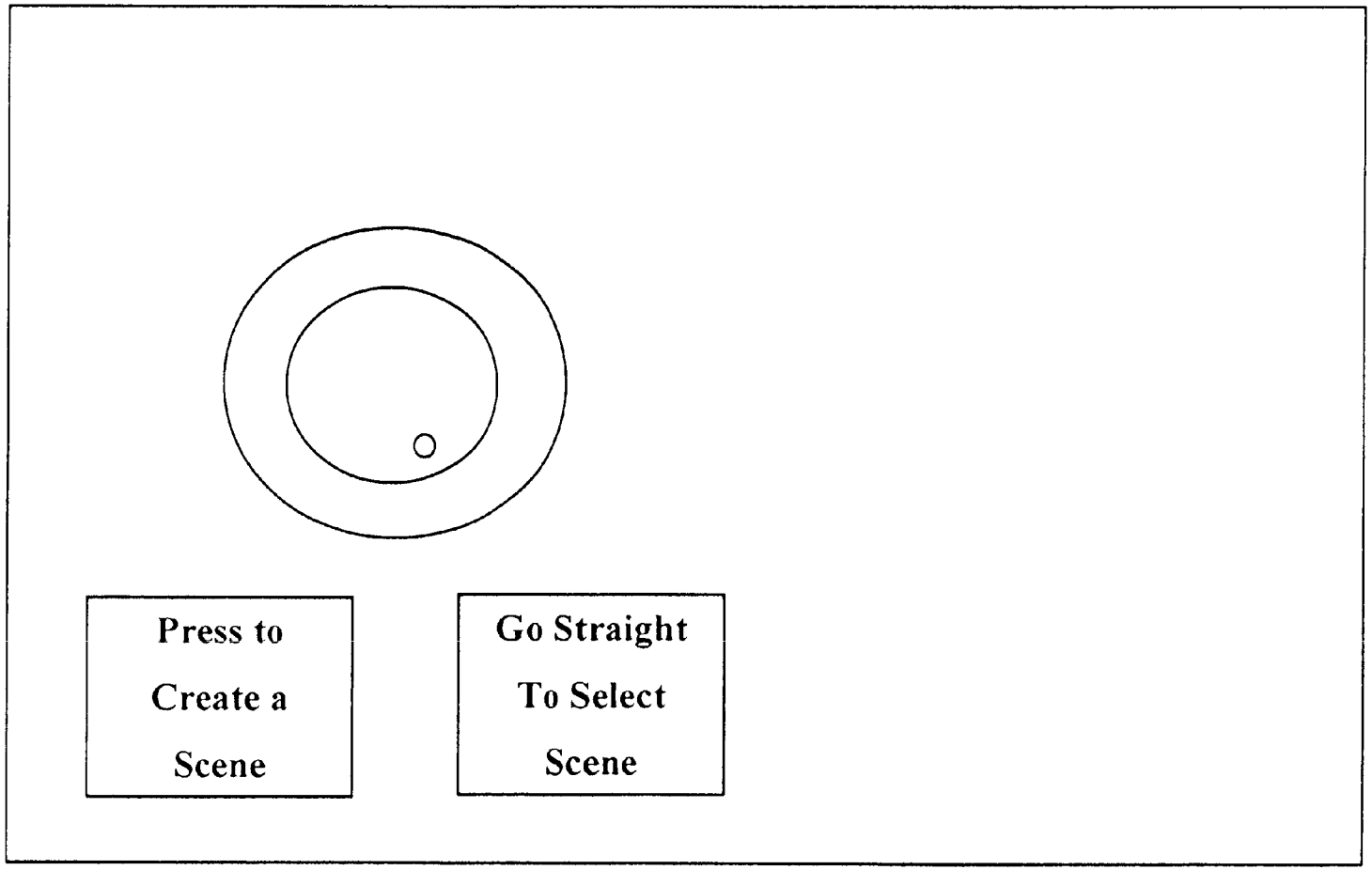
FIG. 10 is a screen shot of the first initial screen presented by the cue controller.

As shown in FIG. 9, quite often in the performing arts, a camera 27 is framed on a single small section 28 of the set which is lighted and properly prepared to yield best results on film. Performers 30 and 31 are expected to arrive at that section 28 on time and begin dialogue on cue. Likewise, the camera dolly 33 being pushed by key grip 34 must be moved into position so that camera operator 35 obtains the optimum shooting angle. The director or AD 29 will painstakingly arrange the performers at different locations on set and expect them to begin walking to section 28 on cue. If neither performer 30 or 31 can view the other during this action, arriving at the required location on time is almost impossible. Thousands of dollars are wasted every time a retake has to be done to get right the synchronization. FIG. 9 shows how director 29 can situate himself at a vantage point where both performers 30 and 31 and camera 27 are visible to him. It is apparent from this vantage point that one performer 30 is closer to section 28 than the other performer 31. Each performer 30 and 31 carries a cueing device 3. Director 29 then uses cue controller 1 to cue the performer 31 furthest from framed section 28. When the moving performer 31 reaches a point equal in distance, in the visual estimation of director 29, from framed section 28 as the stationary performer 30 is, and assuming that both performer 30 and 31 walk at about the same speed, director 29 cues the stationary performer 30 with cue controller 1. Director 29 will also cue key grip 34 and camera operator 35 when to begin moving camera dolly 33. Now both performers 30 and 31, moving at equal speeds, are equidistant from section 28 and will arrive simultaneously. For retakes, the cueing sequence can be recorded using cue controller 1, so that the performers 30 and 31 and camera dolly 33 can be repositioned, and the entire scene can be played back with split second precision on the cueing sequence.

EXAMPLE B

Cueing Stunt Person

In the performing arts, a stunt person is expected to fall from a high building or jump through a window or perform some other dangerous action. Often, the line of sight between the director and the stunt person is blocked and by the nature of the situation, shouting a command is not the best cueing method. A visual indicator (like the LED in the EXAMPLE A) may not provide the best cueing action in the stuntman's situation (for example, he may not have a hand free to hold cueing device to view the LED indicator). Accordingly, the stunt person can wear cueing device 3 in his pocket, the director can press cueing button 11 on cue controller 1, so that cue controller 1 broadcasts a coded RF transmission 2 intended for a particular cueing device 3 carried by the stuntman, and that particular cueing device 3 determines that the message is intended for it by comparing cue identifier codes. Cueing device 3 vibrates and in response, the stunt person jumps. This method preserves the audio track during shooting, or in the case of live theater, prevents embarrassing audible cues which degrade the audience's enjoyment.

EXAMPLE C

Cueing Proximity to Marker

Cueing device 3 may be triggered to vibrate upon a predetermined physical proximity to a marker, typically on the floor of the set, that is adapted to transmit a RF signal coded for that cueing device 3. This way, the director need not use cue controller 1 as described above.

Figure 17:
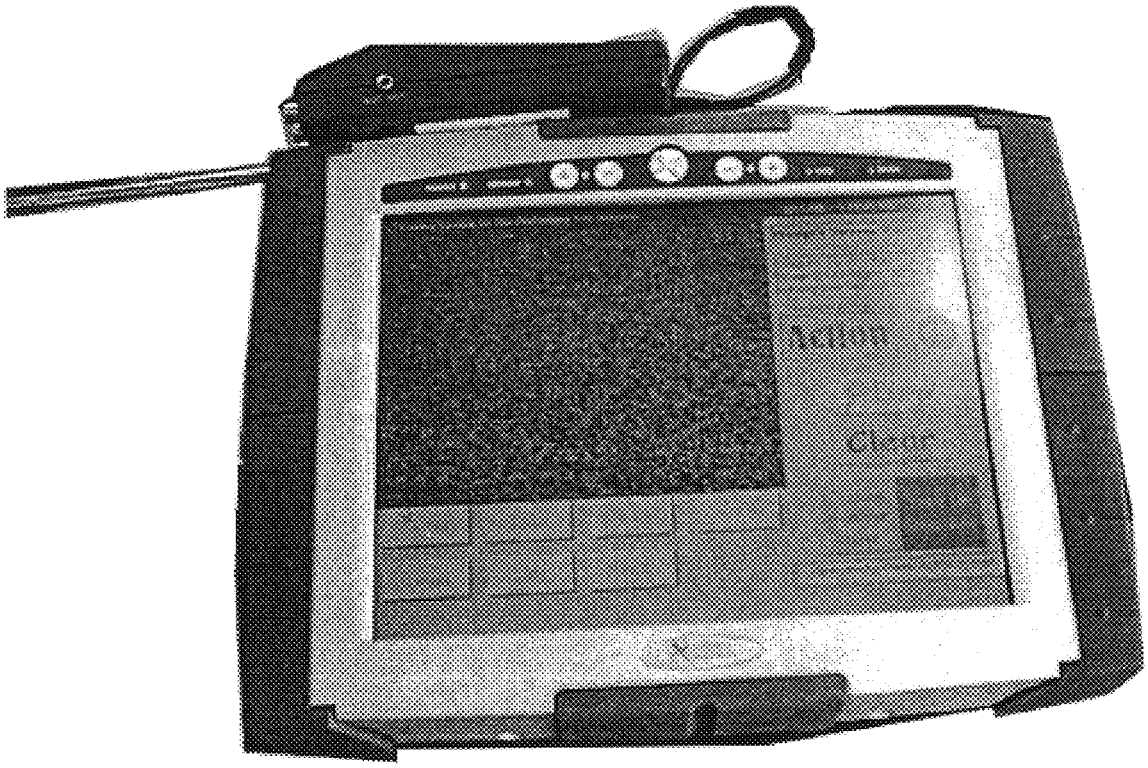
FIG. 17 is a picture of a cue controller as built.

Cue controller 1 may be a a mobile computer (a so-called "PC tablet" such as GeneSys P133 model with Xpod from Xplore Technologies Corp., as shown in FIG. 17. Other components include: Radiometrix Inc. RF microchip transceiver and Nogatech Inc. video capture PCMCIA card.

It will be appreciated that the dimensions given are merely for purposes of illustration and are not limiting in any way. The specific dimensions given may be varied in practising this invention, depending on the specific application.

While the principles of the invention have now been made clear in the illustrated embodiments, there will, be immediately obvious to those skilled in the art, many modifications of structure, arrangements, proportions, the elements, materials and components used in the practice of the invention, and otherwise, which are particularly adapted for specific environments and operational requirements without departing from those principles. The claims are therefore intended to cover and embrace such modifications within the limits only of the true spirit and scope of the invention.

We claim:

1. A cueing system for a director to cue a plurality of performers for a scene according to a script, comprising:

(a) a cueing device to be carried by each performer, for providing an indication to the performer carrying said cueing device, in response to a signal unique to said cueing device;

(b) a cue controller for programmably signalling each cueing device with its own unique signal, whereby the director programs a sequence of cues for a scene by signally each cueing device in the desired sequence with the desired time intervals between each signal and storing said sequence and time intervals.

2. The cueing system of claim 1 wherein said indication is visually discernible to the performer and such indication is provided by said cueing device upon receiving the signal unique for said cueing device from said cue controller.

3. The cueing system of claim 1 wherein said indication is tactically discernible to the performer and such indication is provided by said cueing device upon receiving the signal unique for said cueing device from said cue controller.

4. A master cueing system comprising a plurality of cueing systems of claim 1 and a master cue controller which controls said plurality of cueing systems.

5. The cueing system of claim 1 wherein said cue controller includes a receiver for receiving live video image signals from a camera framed on a preset location.

6. The cueing system of claim 1 wherein said programming comprises the inputting of data for a scene related to each performer's name including the name of the scene, each performer and the indication to be received by the performer.

7. The cueing system of claim 1 further comprising a marker positioned at a predefined location on the set which sends signals unique to one said cueing device, whereby said cueing device provides said indication upon said cueing device becoming proximate to said marker by a predefined distance.

8. The cueing system of claim 1 further comprising adjusting means connected to the focussing mechanisms of a camera, for receiving a signal from one said cueing device and for determining the separation between said cueing device and said camera based on said signal and for adjusting the focussing mechanisms of the camera, whereby the camera is kept focussed continually on the performer carrying said cueing device.

9. A cueing device for providing an indication to its human carrier, comprising:

(a) receiving means for receiving a predefined signal;

(b) indication means for providing an indication to the performer, in response to the receipt of the signal by said receiving means;

(c) housing for said receiving means and said indication means which is profiled in an approximate disk shape of relatively low height.

10. The cueing device of claim 9 wherein said cueing device further comprises transmission means for transmitting a predefined signal.

* * * * *